US009744776B2

(12) United States Patent
Moehringer et al.

(10) Patent No.: US 9,744,776 B2
(45) Date of Patent: Aug. 29, 2017

(54) DEVICE FOR PRINTING ON MULTI-DIMENSIONAL OBJECTS

(71) Applicant: HEIDELBERGER DRUCKMASCHINEN AG, Heidelberg (DE)

(72) Inventors: Markus Moehringer, Weinheim (DE); Henning Niggemann, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/196,124

(22) Filed: Jun. 29, 2016

(65) Prior Publication Data

US 2017/0008304 A1 Jan. 12, 2017

(30) Foreign Application Priority Data

Jul. 8, 2015 (DE) ..... 10 2015 212 757

(51) Int. Cl.
*B41J 3/407* (2006.01)
*B05B 13/04* (2006.01)

(52) U.S. Cl.
CPC ..... *B41J 3/4073* (2013.01); *B05B 13/0431* (2013.01)

(58) Field of Classification Search
CPC ..... B41J 3/4073; B41J 3/4078; B41J 11/20
See application file for complete search history.

(56) References Cited

U.S. PATENT DOCUMENTS 5,613,403 A * 3/1997 Takei ..... B23Q 1/621 108/143
7,819,055 B2 10/2010 Tezuka et al.
2001/0032387 A1* 10/2001 Nagasaki ..... H05K 3/14 29/740
2006/0290763 A1* 12/2006 Kawaguchi ..... B41J 2/16526 347/104
2011/0012952 A1* 1/2011 Chang ..... B41J 3/4073 347/16
2011/0115849 A1* 5/2011 Seki ..... B41J 3/4073 347/37
2011/0148985 A1* 6/2011 Albertalli ..... B41J 19/00 347/37

(Continued)

FOREIGN PATENT DOCUMENTS

DE 142736 C 5/1902
DE 102009003443 A1 8/2010

(Continued)

*Primary Examiner* — Shelby Fidler
(74) *Attorney, Agent, or Firm* — Laurence A. Greenberg; Werner H. Stemer; Ralph E. Locher

(57) ABSTRACT

A device for printing on multi-dimensional objects includes an object carrier for holding and moving the object to be printed on, a tool carrier for receiving stationary processing tools, and a frame to which the tool carrier is fixed. The object carrier has three guide tracks which are disposed perpendicular to one another and each of which is oriented along a respective axis of movement. Carriages are movable on the guide tracks for executing a translatory movement of the object relative to the stationary processing tools. The device may have a modular construction, allowing the device to be adapted to a variety of objects to be printed on.

12 Claims, 9 Drawing Sheets

(56) References Cited

U.S. PATENT DOCUMENTS

| | | | | |
|---|---|---|---|---|
| 2013/0342592 | A1* | 12/2013 | Merz | B41J 3/4073<br>347/2 |
| 2015/0273864 | A1* | 10/2015 | Moehringer | B41J 11/002<br>347/16 |

FOREIGN PATENT DOCUMENTS

| | | | |
|---|---|---|---|
| DE | 102010004496 | A1 | 7/2011 |
| JP | 2007001164 | A | 1/2007 |
| WO | 2013170888 | A1 | 11/2013 |

* cited by examiner

DEVICE FOR PRINTING ON MULTI-DIMENSIONAL OBJECTS

CROSS-REFERENCE TO RELATED APPLICATION

This application claims the priority, under 35 U.S.C. §119, of German Patent Application DE 10 2015 212 757.5, filed Jul. 8, 2015; the prior application is herewith incorporated by reference in its entirety.

BACKGROUND OF THE INVENTION

Field of the Invention

The invention relates to a device for printing on multidimensional objects, the device including an object carrier for holding and moving the object to be printed on, a tool carrier for receiving stationary processing tools, and a frame to which the tool carrier is fixed.

Devices that guide the object to be printed on or that guide the print heads by using multi-axis robots, also known as articulated robots, are known in the art for printing on objects. Such a device is described, for instance, in German Patent Application DE 10 2010 004 496 A1. A disadvantage of those devices is their lack of rigidity, which involves a risk of motion errors due to static deformation and vibration. Another disadvantage is that the motion inaccuracies of the drives of the articulated robot accumulate and thus increase. All drives of the robot need to be actuated and moved in exact synchronism with one another even when the head of the articulated robot is merely to be moved at a continuous speed over a linear path. Even small errors of only one drive accumulate to a large total error, which means that the requirements in terms of the accuracy of movement required for high-precision prints are no longer met.

On the other hand, devices are known wherein a rotation-symmetric object to be printed on is rotated by an object carrier and a print head is moved relative to the object. Such a device is described, for instance, in U.S. Pat. No. 7,819,055 B2. A disadvantage of the described device is that on one hand, the movement of the print head requires a complex bearing and a complex ink supply to the print head. On the other hand, the versatility of the device is limited because it is only capable of printing on very compact objects.

SUMMARY OF THE INVENTION

It is accordingly an object of the invention to provide a device for printing on multi-dimensional objects, which overcomes or at least reduces the herein aforementioned disadvantages of the heretofore-known devices of this general type and which allows a large variety of objects to be printed on with a high degree of accuracy.

With the foregoing and other objects in view there is provided, in accordance with the invention, a device for printing on multi-dimensional, namely three-dimensional spatial objects, comprising an object carrier for holding and moving the object to be printed on, for instance a sphere, a cylinder, or a cuboid, a tool carrier for receiving multiple processing tools that are stationary during the processing operation, and a frame, in particular a gantry-shaped frame, on which the tool carrier is mounted, i.e. suspended. In accordance with the invention, the object carrier has three guide tracks and three carriages movable thereon. The guide tracks are perpendicular or orthogonal to one another and each of them is oriented along a respective axis of movement. Each guide track is assigned a carriage for a translatory movement of the object relative to the stationary processing tools during the processing operation. For instance, the construction is such that a second guide track is disposed on the first carriage and a third guide track is disposed on the second carriage. An object carrier for gripping or clamping an object or holding it by suction may be disposed on the third carriage. Linear direct drives or spindle units may be provided as drives for the carriages along the guide tracks.

In accordance with another advantageous feature of the printing device of the invention, a first guide track has two guide rails that are oriented to be parallel to one another and are in particular horizontal guide rails disposed in a horizontal plane. A respective guide rail of the first guide track may be disposed on a respective side wall in a position to be elevated relative to the foundation or a base plate of the printing device. This allows the objects to be printed to be loaded into the device in an easy, ergonomic way and provides a way of lowering the object further down along the vertical guide track.

In accordance with a further particularly advantageous and thus preferred feature of the printing device of the invention, the two side walls are interconnected and the two side walls form or represent the arms of a U profile. Thus a particularly rigid and thus stable construction of the device is achieved. In accordance with an advantageous further feature, the U profile may extend beyond the frame. The U profile may be of unipartite construction or may preferably be composed of at least three elements or modules of identical construction. In this way, it is possible to process even especially long objects and to implement an automated supply and removal of the objects.

In accordance with an added advantageous feature of the printing device of the invention, the first guide track is embodied as a gantry carriage having a gantry drive, and two separate motors move the object along the first axis of movement due to an angle-synchronous actuation, allowing the object to move along the first axis of movement without jamming. The motors that are used for this purpose are in particular linear servomotors.

In accordance with an additional feature of the printing device of the invention, at least one print head, in particular an inkjet print head, is provided as a processing tool of the device. Optionally, a pre-coat device, a plasma treatment device, a laser engraving device and/or a drier may be provided as further processing tools. For multicolor printing, a plurality of print heads is provided in a corresponding way. In accordance with a particularly advantageous embodiment, a pre-coat device, an inkjet print head, and a drier are provided at a minimum.

In accordance with yet another advantageous feature of the printing device of the invention, the height of the tool carrier is adjustable and the tool carrier is movable along substantially vertical supports of the frame and lockable in position, allowing an adaptation to objects of varying sizes. In accordance with an advantageous further development, the tool carrier has a recess for every processing tool to receive the processing tool. The recess is constructed to allow the respective processing tool to be inserted in two alternative positions that are offset by an angle of 90° relative to one another. A first position is advantageously oriented to be parallel to the first axis of movement and a second position is preferably oriented to be parallel to the second axis of movement. Thus the orientation of the processing tools may be selected as a function of the object to be printed on and of the image to be printed. It is additionally advantageous if every recess is capable of locking a respective tool in both a lower operating position and in an upper standby position. Alternatively, there may be an operating position inside an operating region and a standby position outside an operating region, both positions being located in a horizontal plane.

In accordance with a first alternative embodiment of the device of the invention, the object carrier has a first axis of rotation for rotating the object, the first axis of rotation is oriented to be parallel to the first guide track and to the first axis of movement. In accordance with a further alternative embodiment, the object carrier of the device additionally has a second axis of rotation for rotating the object, the second axis of rotation is oriented to be parallel to the first guide track and to the second axis of movement. In accordance with a third alternative embodiment, the object carrier of the device additionally has a third axis of rotation for rotating the object, the third axis of rotation is oriented to be parallel to the third guide track and to the third axis of movement. Thus the device has a modular construction. The basic module, which has three axes of translatory movement as described above, may be enhanced by one, two, or three additional axes of rotation as a function of the object to be printed on and of the image to be printed. Since the deviations of the individual servo-electric drives from their target movements add up to a total error of the desired movement between the object to be printed on and the processing tool, the provision of the lowest possible number of axes of rotation may keep the deviation on a low level. A modular construction of the printing device including one, two, or three axes of rotation allows the required number of axes of rotation to be easily selected as a function of the object to be printed on.

As far as it makes sense from a technical point of view, combinations of the invention as described above and of the advantageous further developments of the invention likewise form advantageous further developments of the invention.

Other features which are considered as characteristic for the invention are set forth in the appended claims. Further advantages and embodiments of the invention that are advantageous in structural and functional terms will become apparent from the dependent claims and the description of exemplary embodiments with reference to the appended figures.

Although the invention is illustrated and described herein as embodied in a device for printing on multi-dimensional objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1B is a perspective view of the device of FIG. 1A with an object to be printed on;

DETAILED DESCRIPTION OF THE INVENTION

Figure 1A:
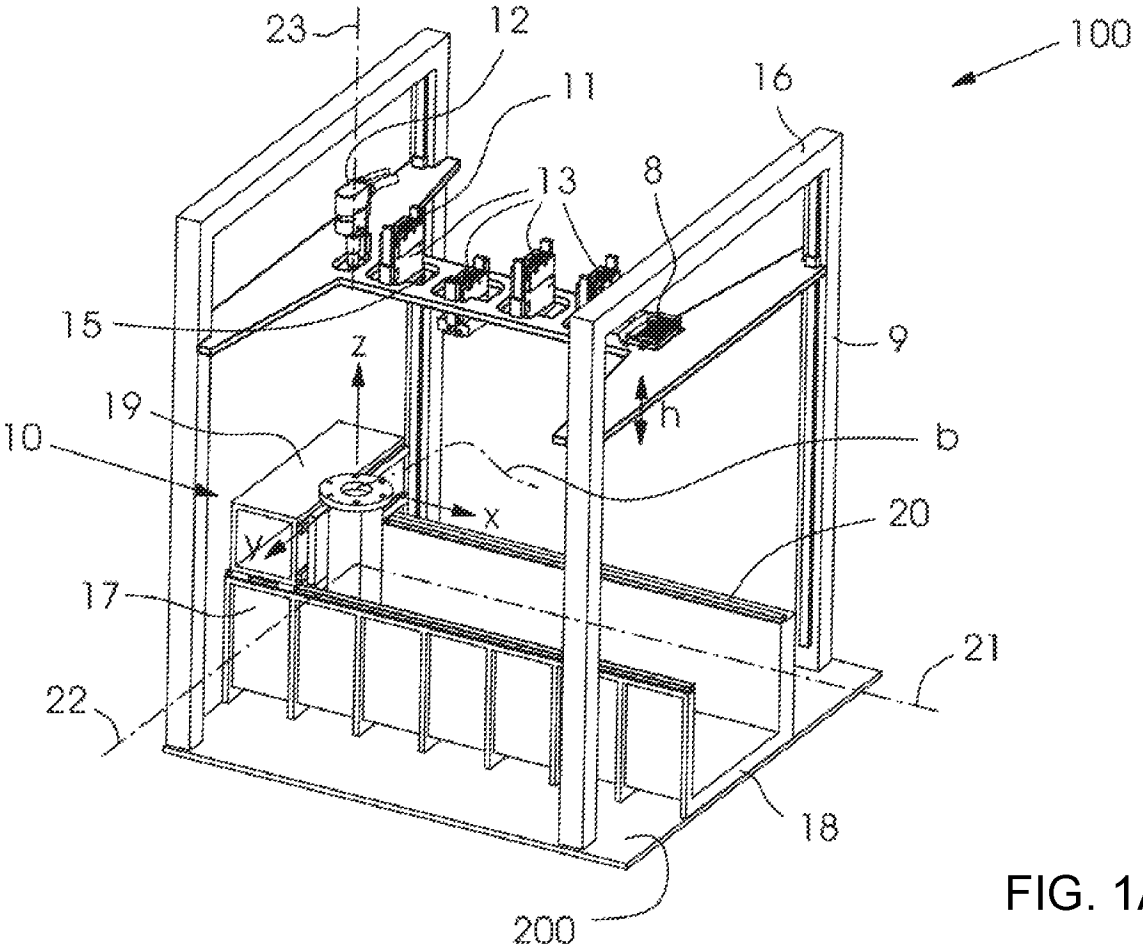
FIG. 1A is a diagrammatic, perspective view of a printing device of the invention.

Referring now in detail to the figures of the drawings which are not drawn to scale and in which elements and components that correspond to one another have the same reference symbol and first, particularly, to FIG. 1A thereof, there is seen a modular printing device 100 of the invention. The printing device 100 has a tool carrier 11 held in vertical supports 9 of a frame 16. The tool carrier 11 is vertically movable and lockable in the vertical supports 9 so that a height adjustment h of the tool carrier is possible. An object carrier 10 for moving a non-illustrated object to be printed on relative to the tool carrier 11 and its tools 12, 13, 14 is disposed below the tool carrier 11. The object carrier 10 rests on or is fixed to a bottom or foundation or base plate 200.

In accordance with the invention, the construction of the object carrier 10 is as follows:

A gantry carriage 19 having a gantry drive is fixed to a U-shaped U profile element 18 having two side walls 17. The gantry carriage 19, which provides a jam-free movement in an x direction, forms a first axis of movement 21 in the x direction. A second axis of movement 22 in the Y direction is disposed at a right angle relative thereto and a third axis of rotation 23 in a Z direction is disposed at a right angle relative thereto. The axes form the axes of movement of the object carrier 10, allowing a non-illustrated object that is to be printed on and is held by the object carrier 10 to be moved along any desired path of movement b relative to the tool carrier 11, which is stationary during the processing operation.

Figure 1B:
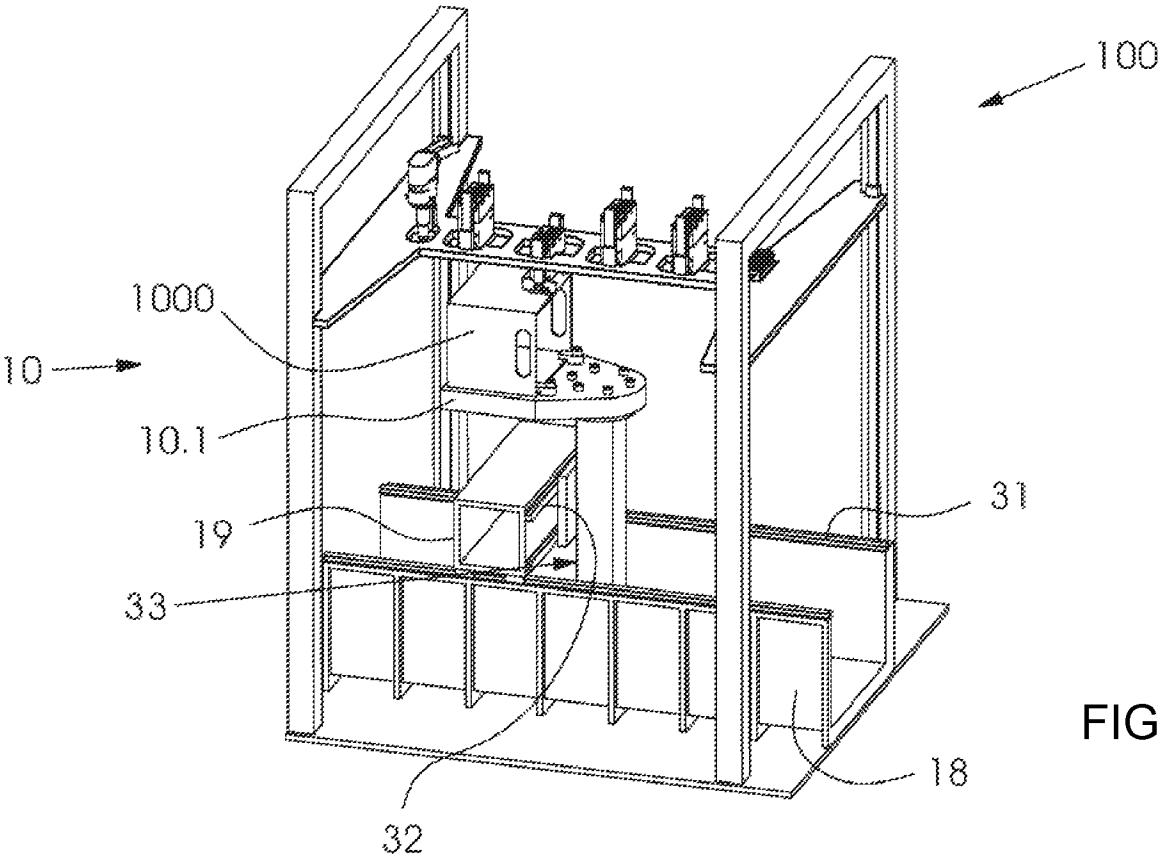

As is apparent from FIG. 1B, the second axis of movement 22 is implemented by a second guide track including a guide carriage 32. The second guide track is disposed on the gantry carriage 19 with the gantry drive as a first guide track with a guide carriage 31. The first guide track has two, in particular horizontal, guide rails 20 oriented parallel to one another. The third axis of movement 23 is implemented by a third guide track with a guide carriage 33. The third guide track in turn is disposed on the second guide track with the guide carriage 32. In the embodiment of the printing device 100 shown in FIG. 1B, the object carrier 10 thereof includes an object mount 10.1 including clamps for holding an object 1000 to be printed on, in this case a cuboid box. The object mount 10.1 is moved by using the guide tracks and guide carriages 31, 32, 33. The object 1000 to be printed on may be moved relative to the stationary tool carrier 11 by using a movement of the object mount 10.1. As compared to the object mount 10.1 shown in FIG. 1A, the object mount 10.1 in the illustration of FIG. 1B has been moved counter to the Y direction and in the x and z directions along the axes of movement 21, 22, 23. While the first guide track with the guide carriage 31 is embodied as a gantry carriage 19 with a gantry drive, the second guide track with the guide carriage 32 and the third guide track with the guide carriage 33 may have servo-electric drives, which may in particular be embodied as linear direct drives or spindle units. Thus, a self-locking spindle drive may represent an advantageous embodiment of the third guide track with the guide carriage 33. The guide carriages 31, 32, 33 thus form a servoelectrically driven x, y, z linear system that allows an object mount 10.1 to be moved along almost any desired path of movement b.

Figure 2:
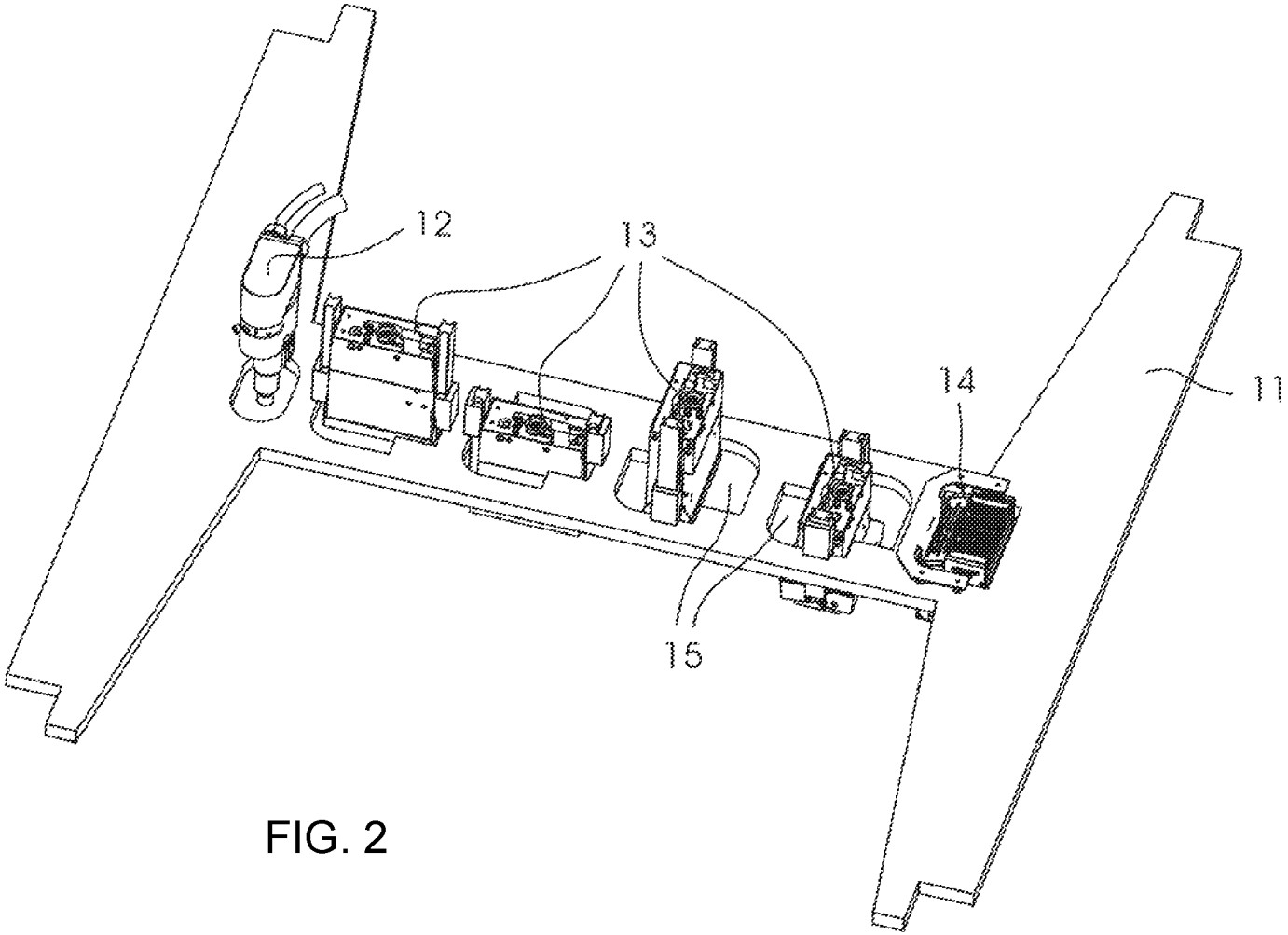
FIG. 2 is an enlarged perspective view of a tool carrier of the device.

FIG. 2 is a more detailed view of the tool carrier 11: the tool carrier 11 carries the processing tools for pre-treating, printing, and drying the object 1000 to be printed on as required for an inkjet printing operation. In the embodiment of FIG. 2, a pre-coat device 12, embodied as a plasma pre-treatment unit, four inkjet print heads 13, and a drier 14 are provided. The tools 12, 13, 14 are received by respective recesses 15 of the tool carrier 11. All of the processing tools 12, 13, 14 may be displaced relative to the tool carrier 11 between a lower operating position and an upper standby position and may be fixed in position. In the illustration of FIG. 2, the pre-coat device 12, the first print head 13, and the third print head 13 are in standby positions whereas the second inkjet print head 13, the fourth inkjet print head 13, and the drier 14 are in lowered operating positions. In an alternative embodiment, the processing tools 12, 13, 14 may be displaced from an operating position to a standby position in a horizontal displacement and may be fixed therein. The recesses 15 for receiving the inkjet print heads 13 are embodied in such a way that a respective inkjet print head 13 may be mounted in two alternative positions that are rotated relative to one another through 90°. In other words, the inkjet print heads 13 have a first mounting position at 0° and a second mounting position in which the respective print head 13 has been rotated through 90°, allowing the orientation of the inkjet print heads 13 to be adapted to the object 1000 to be printed on.

Figure 3:
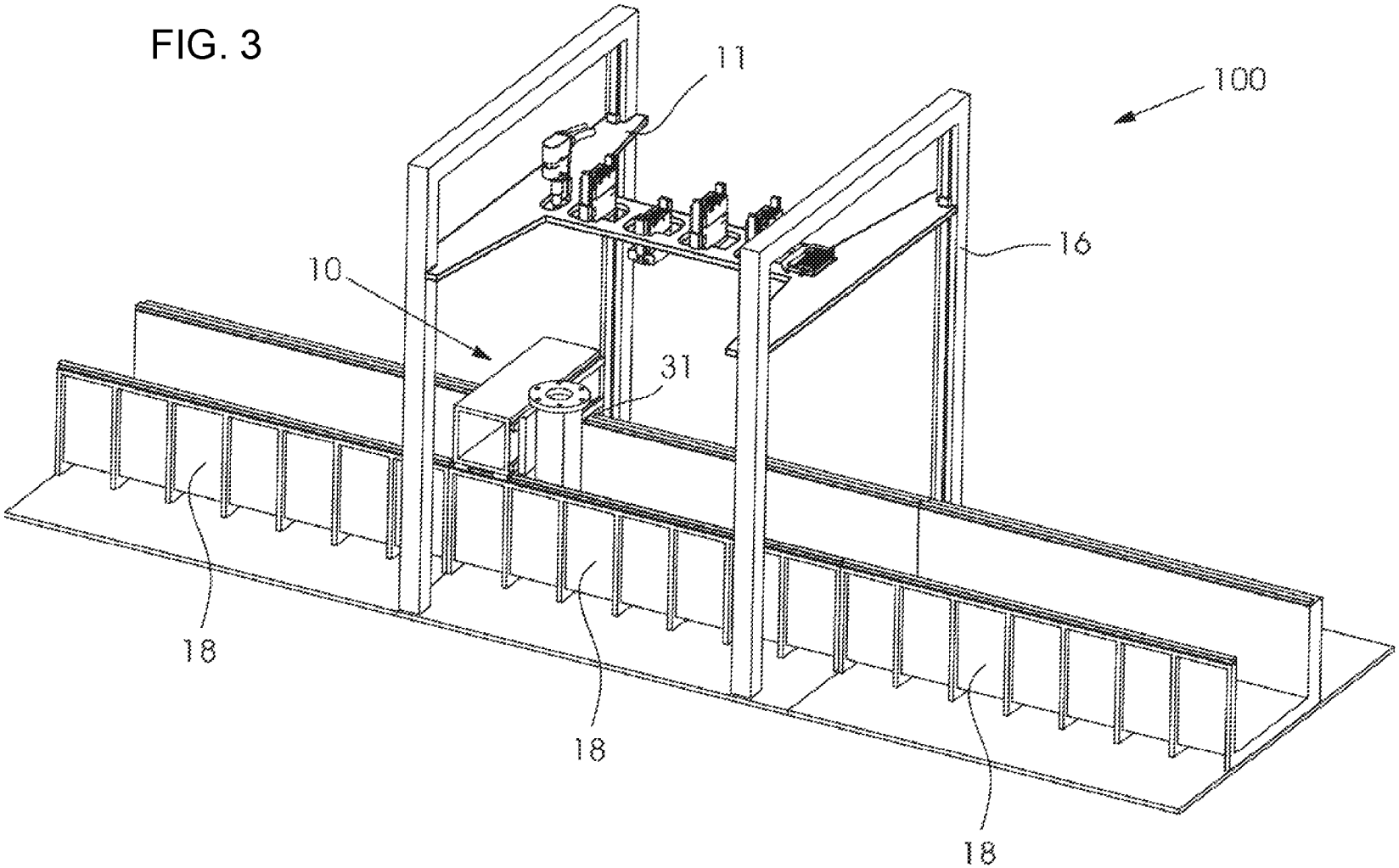
FIG. 3 is a perspective view of an elongated version of the device.

In order to be able to adapt the printing device 100 to objects to be printed of varying sizes in a flexible way, and to allow the objects 1000 to be printed on to be automatically supplied to and removed from the object carrier 10, the possible displacement path of the first guide track with the guide carriage 31 in or against the x direction may be increased by extending the U profile 18 located underneath the tool carrier 11 with further U profile elements 18 as shown in FIG. 3.

As will be explained in more detail based on FIGS. 4A, 4B, and 4C, the printing device 100 which was described and explained above based on the figures may be enhanced by adding axes of rotation 41, 42, 43 for rotating the objects 1000 to be printed on as a function of the structure of the objects 1000 to be printed on.

Figure 4A:
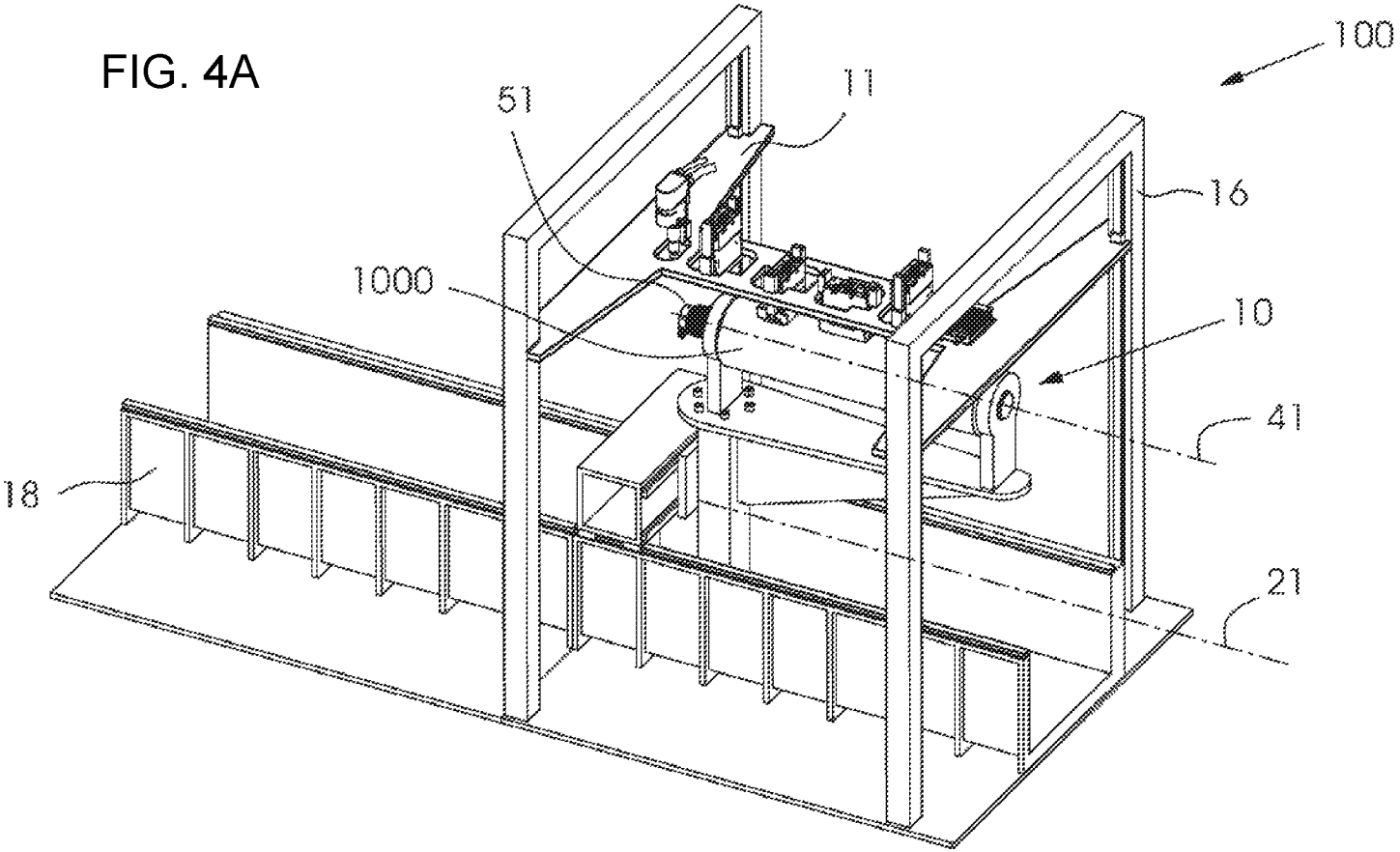
FIGS. 4A-4E are perspective views of different embodiments of the device.

In accordance with a first enhancement shown in FIG. 4A, the object carrier 10 of the printing device 100 has a rotation servo drive 51 for rotating an object 1000 to be printed on about a first axis of rotation 41. The first axis of rotation 41 is oriented to be parallel to the first axis of movement 21. In order to avoid reduction gearing and thus transmission errors that would otherwise occur for instance due to irregularities in the driving motion as a result of meshing teeth in gear trains, the rotation servo drive 51 is preferably a direct servo drive, in particular a torque motor. A printing device 100 of this type constructed in accordance with FIG. 4A allows the third print head 13 to print ribbon-shaped printing strips as well as printing strips along the longitudinal axis of the object 1000 to be printed on. In a first case, the rotation servo drive 51 generates the rotary printing motion, providing the progression of the image strips by a movement of the gantry carriage 19. In a second case, the gantry carriage 19 generates the printing motion, providing the progression of the image strips by a rotary movement of the rotation servo drive 51. An object carrier 10 that has been enhanced by a first axis of rotation 41 in this way in particular allows rotary bodies having a straight circumferential line such as cylinders and cones to be printed on as objects 1000 to be printed on. However, it is also possible to print on surfaces that are irregularly curved in one plane.

Figure 4B:
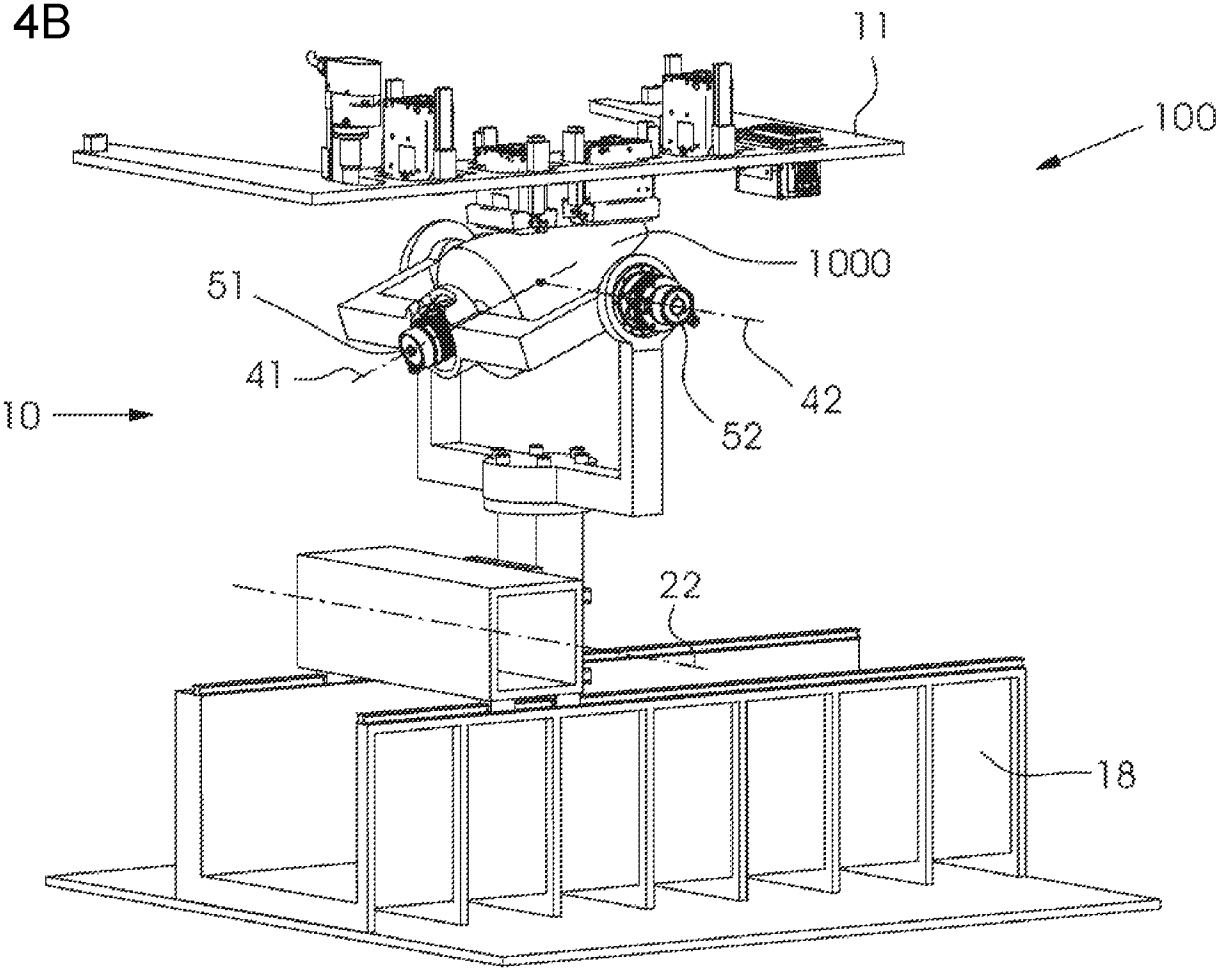

In accordance with an enhancement of the printing device 100 as shown in FIG. 4B, in addition to the first axis of rotation 41, the object carrier 10 includes a second axis of rotation 42 oriented to be parallel to the second axis of movement 22. A second rotation servo drive 52 is provided in order to rotate an object 1000 to be printed on about the axis of rotation 42. Such a printing device 100 is capable of printing on objects 1000 to be printed on with surfaces that are curved in two planes. For reasons of clarity, the frame 16 of the device 100 is not shown in FIG. 4B.

The axes of rotation 41, 42 and the rotation drives 51, 52 are supported on forks. An exterior fork which has end points that carry the second rotation servo drive 52 is fixed to the third guide track with the guide carriage 33 and receives an interior fork, at the center of which the first rotation servo drive 51 is disposed. A drive shaft of this first rotation servo drive 51 in turn carries the object 1000 to be printed on. Thus the second rotation servo drive 52 may rotate the interior fork and the first rotation servo drive 51 may rotate the object 1000 to be printed on.

The object 1000 to be printed on is advantageously mounted to the object carrier 10 in such a way that existing axes of symmetry of the object 1000 to be printed on coincide with the axes of rotation 41, 42. Thus the required movement of the object 1000 to be printed on during the printing operation may be minimized. It is further advantageous if an object 1000 to be printed on is mounted to the object carrier 10 in such a way that the center of gravity S of the object 1000 to be printed on is located at the intersection of the first axis of rotation 41 and the second axis of rotation 42. In this case, the rotation servo drives 51, 52 do not need to apply any holding torque.

Figure 4C:
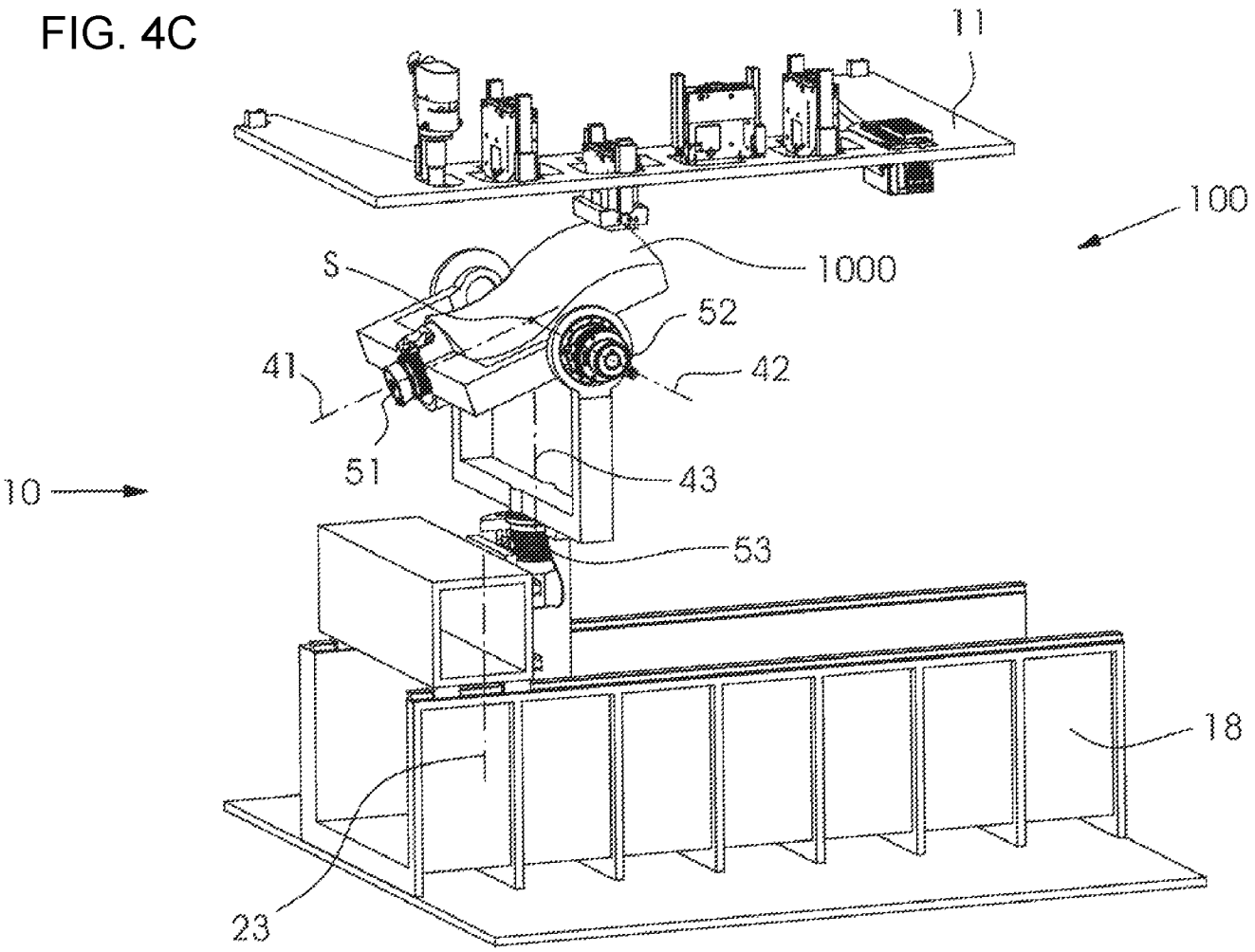

These rules for mounting an object 1000 to be printed on to the object carrier 10 also apply to an enhanced printing device 100 including a third axis of rotation 43 as shown in FIG. 4C. The third axis of rotation 43, which is oriented to be parallel to the third axis of movement 23, is provided in addition to the first axis of rotation 41 and the second axis of rotation 42. For this purpose, a third rotation servo drive 53 for rotating the exterior fork is provided on the third guide track with the guide carriage 33. An enhanced printing device 100 of this type may be used to freely position an object 1000 to be printed on, which may be aligned in any desired way with the aid of the three rotation servo drives 51, 52, 53. This allows nearly any desired printing strips to be printed onto curved surfaces of objects 1000 to be printed on.

Figure 4D:
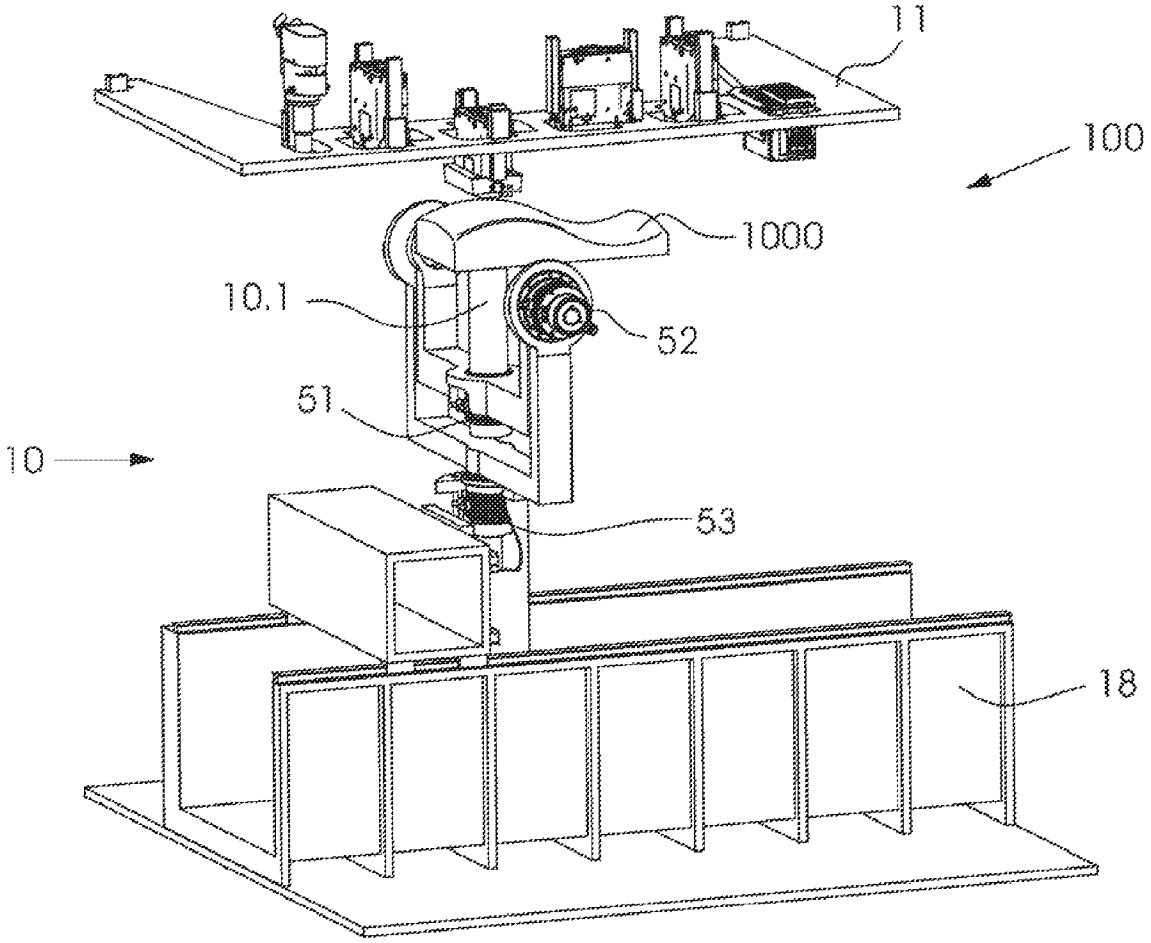

FIG. 4D illustrates an alternative construction of the device 100 having a cylindrical object mount 10.1.

Figure 4E:
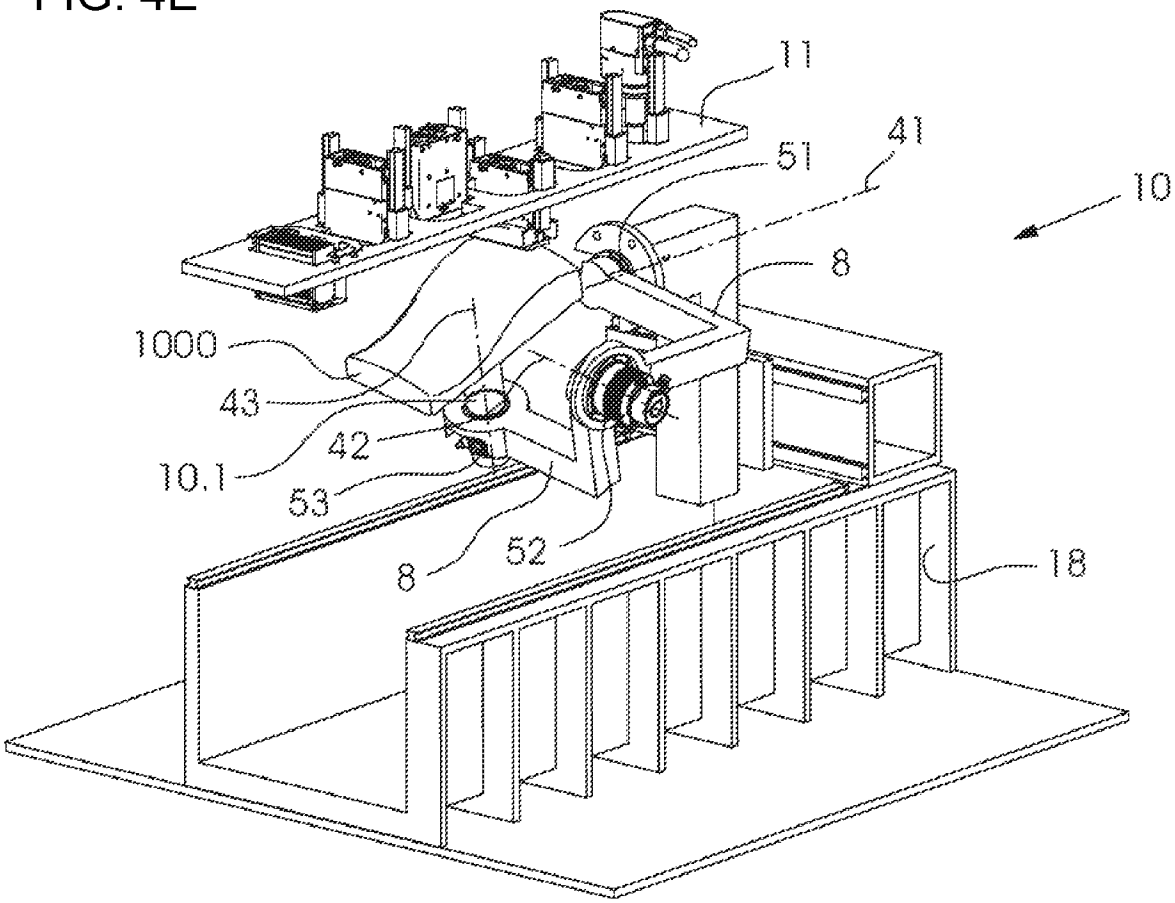

FIG. 4E illustrates an alternative configuration of the axes of rotation 41, 42, 43. The drives 52, 53 are fixed to L-shaped arms 8 rather than forks. The first rotation drive 51 for causing a rotation about the first axis of rotation 41 is fixed to the guide carriage 33 of the third guide track. The second rotation drive 52 for rotation about the second axis of rotation 42 is disposed on the first axis of rotation 41 at a right angle relative thereto via a right-angled, L-shaped arm 8. The third rotation drive 53 for rotation about the third axis of rotation 43 is disposed on the second axis of rotation 42 via a further right-angled, L-shaped arm 8. A substantial advantage of this embodiment over the embodiment of FIG. 4D is deemed to be that all three axes of rotation 41, 42, 43 are perpendicular to one another in respective pairs, even when the print head 13 or another processing tool 12, 14 is located precisely opposite the mounting location of the mount 10.1 of the print object 1000.

In the embodiment disclosed with reference to FIG. 4D including a vertical axis of rotation, the first and third axes of rotation are coaxial in this position (see FIG. 4D), which corresponds to a singularity of the object carrier 10. In this singularity, the device 100 is not capable of rotating the print object 1000 in any desired way.

The invention claimed is:

1. A device for printing on multidimensional objects, the device comprising:

a frame;

stationary processing tools;

a tool carrier for receiving said stationary processing tools, said tool carrier being fixed to said frame;

an object carrier for holding and moving an object to be printed on, said object carrier having three guide tracks being oriented perpendicularly to one another, each of said three guide tracks being oriented along a respective one of three axes of movement and said three guide tracks including a third guide track;

said three axes of movement including first, second and third axes of movement, said object carrier having first, second and third axes of rotation for rotating the object, said first axis of rotation being oriented parallel to said first axis of movement, said second axis of rotation being oriented parallel to said second axis of movement and said third axis of rotation being oriented parallel to said third axis of movement;

two right-angled arms, said first axis of rotation being disposed on said third guide track, said second axis of rotation being disposed on said first axis of rotation through one of said right-angled arms and said third axis of rotation being fixed to said second axis of rotation through the other of said right-angled arms; and carriages each being movable on a respective one of said three guide tracks for carrying out a translatory movement of the object relative to said stationary processing tools.

2. The printing device according to claim 1, wherein said three guide tracks include a first guide track having two guide rails oriented parallel to one another.

3. The printing device according to claim 2, wherein said two guide rails are two horizontal guide rails.

4. The printing device according to claim 2, which further comprises a foundation or base plate, and two side walls to be elevated over said foundation or base plate, each of said two guide rails being disposed on a respective one of said side walls.

5. The printing device according to claim 4, wherein said two side walls are interconnected, forming arms of a U profile.

6. The printing device according to claim 5, wherein said U profile extends beyond said frame.

7. The printing device according to claim 6, wherein said U profile is formed of three elements of identical construction.

8. The printing device according to claim 2, wherein said first guide track is constructed as a gantry carriage with a gantry drive.

9. The printing device according to claim 1, wherein at least one of said processing tools is at least one print head.

10. The printing device according to claim 9, wherein said at least one print head is at least one inkjet print head.

11. The printing device according to claim 1, wherein said frame has substantially vertical supports, and said tool carrier is adjustable in height and movable along said substantially vertical supports.

12. The printing device according to claim 1, wherein said tool carrier has recesses formed therein, and each of said processing tools is mountable in a respective one of said recesses in two alternative positions being rotated through 90° relative to one another.

* * * * *